US010032355B2

(12) United States Patent
Tilley

(10) Patent No.: US 10,032,355 B2
(45) Date of Patent: Jul. 24, 2018

(54) LEAK DETECTION DEVICE

(71) Applicant: Coke M. Tilley, Clarkson Valley, MO (US)

(72) Inventor: Coke M. Tilley, Clarkson Valley, MO (US)

( * ) Notice: Subject to any disclaimer, the term of this patent is extended or adjusted under 35 U.S.C. 154(b) by 0 days.

(21) Appl. No.: 15/646,359

(22) Filed: Jul. 11, 2017

(65) Prior Publication Data

US 2017/0323551 A1 Nov. 9, 2017

Related U.S. Application Data

(63) Continuation-in-part of application No. 14/818,433, filed on Aug. 5, 2015.

(60) Provisional application No. 62/033,722, filed on Aug. 6, 2014.

(51) Int. Cl.

| | |
|---|---|
| ***G08B 21/00*** | (2006.01) |
| ***G08B 21/18*** | (2006.01) |
| ***E03D 11/16*** | (2006.01) |

(52) U.S. Cl.
CPC ..... *G08B 21/18* (2013.01); *E03D 11/16* (2013.01)

(58) Field of Classification Search
CPC ..... G08B 21/18; E03D 11/16
USPC ..... 340/605, 533, 539.12, 602; 359/265; 73/23.31, 25.03, 46
See application file for complete search history.

(56) References Cited

U.S. PATENT DOCUMENTS

2010/0229724 A1* 9/2010 Tokuda ..... G01N 15/0656 96/19
2013/0048608 A1* 2/2013 Pasqualin ..... H01L 21/67294 216/83
2016/0376626 A1* 12/2016 Uchiyama ..... C12Q 1/006 205/777.5

FOREIGN PATENT DOCUMENTS

WO WO 2012042903 A1 * 4/2012 ..... C12Q 1/004

* cited by examiner

*Primary Examiner* — Dhaval Patel
(74) *Attorney, Agent, or Firm* — Douglas E. Warren

(57) ABSTRACT

A leak detection device that detects leaks of an electrically conductive substantive between any installed device and any mounting surface upon which the installed device has been placed such that the leak detection device is disposed between the installed device and the mounting surface such that when the conductive substance completes an electrical circuit between a first detection conductor and a second detection conductor disposed on the substrate a circuit is completed to allow a leak detection alarm signal to be operatively communicated to an alarm generating device.

11 Claims, 5 Drawing Sheets

LEAK DETECTION DEVICE

CROSS REFERENCE TO RELATED APPLICATIONS

This application claims priority to U.S. Provisional Application No. 62/033,722 filed on Aug. 6, 2014, and to U.S. Nonprovisional patent application Ser. No. 14/818,433 filed on Aug. 5, 2015, wherein the entire disclosures of each of those prior applications are incorporated by reference is if fully stated herein.

STATEMENT REGARDING FEDERALLY SPONSORED RESEARCH

Not Applicable.

BACKGROUND OF THE INVENTION

Undetected and uncontrolled toilet leaks within building structures often result in disastrous consequences. The damages caused by such leaks can range from destroying hardwood floors and carpeting, to requiring the replacement of walls, and, in the worst case scenario, complete gutting of a structure to replace not only the building components, but also the items that were stored within the building when the leak occurred. The costs of this type of damage can range from thousands of dollars to millions of dollars.

Various devices can be found that are generally capable of detecting moisture levels that can indicate a leak is in progress. Most of those devices are installed at or near water supply points such as faucets, water heaters, washing machine connections, and toilet bowl water supply lines. Most toilet related leak detection devices focus on three primary potential leak sources. First, the water supply line that fills the toilet reservoir can leak and there are a number of earlier devices that serve this purpose and detect those leaks. Second, there are devices that detect leaks from the toilet bowl reservoir to identify any leaks between the reservoir and the toilet bowl. Finally, there are leak detection devices that examine the top of the toilet bowl upon which the toilet seat is mounted. That type of unit monitors the top edge of the toilet bowl to sense any water that runs over the edge of the toilet bowl if the toilet sewer lines are clogged for some reason and the toilet bowl overfills when the toilet reservoir attempts to refill the toilet bowl after flushing.

While the above devices are adequate for detecting those three types of toilet leaks, there is another toilet location that is also prone to leak for which there are presently no adequate leak detection devices. That overlooked location is the attachment point where the bottom of the toilet connects to the sewer line for disposal of the waste products deposited into the toilet bowl.

When the toilet is connected to those sewer lines, the toilet is normally mounted onto a toilet mounting flange or closet flange that may rest upon a matching sewer connection protruding upward from the floor of the restroom. The toilet mounting flange is usually circular and has two primary sets of mounting holes. The first set of mounting holes anchors the mounting flange to the floor of the restroom. The second set of mounting holes connects the bottom of the toilet to the upper surface of the mounting flange and usually includes at least two threaded rods that extend upward from the mounting flange for insertion of those rods through two matching mounting holes in the bottom of the toilet. Before the toilet is mounted onto the toilet mounting flange, a seal is positioned between the toilet and the toilet mounting flange. The seal is commonly a circular shaped wax seal, but can also be made of rubber or any other type of material that can properly seal the joint between the toilet and the toilet mounting flange. The seal is intended to prevent any fluids or sewer gases from passing between the toilet and the connection to the sewer lines that might be caused by either backed up sewer lines or from the waste products flushed down the toilet. Those types of leaks can be caused by problems such as deteriorated seals or by improper installation of the toilet.

For example, circular shaped wax seals normally do a good job of preventing any leakage between the toilet bowl and the toilet mounting flange. Over time, however, the wax seals can deteriorate. Seals made from rubber can also deteriorate over time and fail to keep the joint tight. In some cases, bad installation practice can also result in an incomplete sealing. In yet other cases, the toilet may be mounted in such a way that the toilet can rock back and forth as the toilet rests upon the toilet mounting flange and that rocking can damage a wax seal. Finally, the seal itself can deteriorate through hardening of the wax or can be deformed in such a way that the seal is incomplete.

Regardless of the material used for the seal, when the seal fails to do its job, fluid leakage can quickly occur between the bottom of the toilet and the toilet mounting flange. In some cases, that leakage can be very substantial and can result in a great deal of damage to the floor wherever the toilet is installed, and potentially, to floors, ceilings, and walls that are located below the restroom. Additionally, due to the location of the seal between the toilet and the toilet mounting flange, the condition of the seal is hidden from view. In many situations that can mean leaks between the toilet and the toilet mounting flange can also be hidden from view. When that occurs, substantial damage can be done to the floor of the restroom before any leak between the toilet and the toilet mounting flange is detected.

Although there are a wide range of devices that attempt to prevent leaking from the seal by improving the installation method of the toilet bowl onto the toilet mounting flange, there are no devices that can readily detect whether such leakage has occurred. It would be very useful to introduce a device that can provide some type of signal that can be used to notify users that a leak is occurring at a connection point between the device and a mounting surface so that the leak can be quickly repaired to prevent serious damage.

SUMMARY OF THE INVENTION

This section provides a general summary of the disclosure, and is not a comprehensive disclosure of its full scope or all of its features. In accordance with the various embodiments of the present invention, this invention relates to a detection device which includes elements that can allow a signal to be communicated and/or notify others that a leak has occurred between two surfaces. Further areas of applicability will become apparent from the description provided herein. The description and specific examples in this summary are intended for purposes of illustration only and are not intended to limit the scope or the claims of the present disclosure.

DESCRIPTION OF THE DRAWINGS

In the accompanying drawings which form part of the specification.

Corresponding reference numerals indicate corresponding steps or parts throughout the several figures of the drawings.

Figure 1:
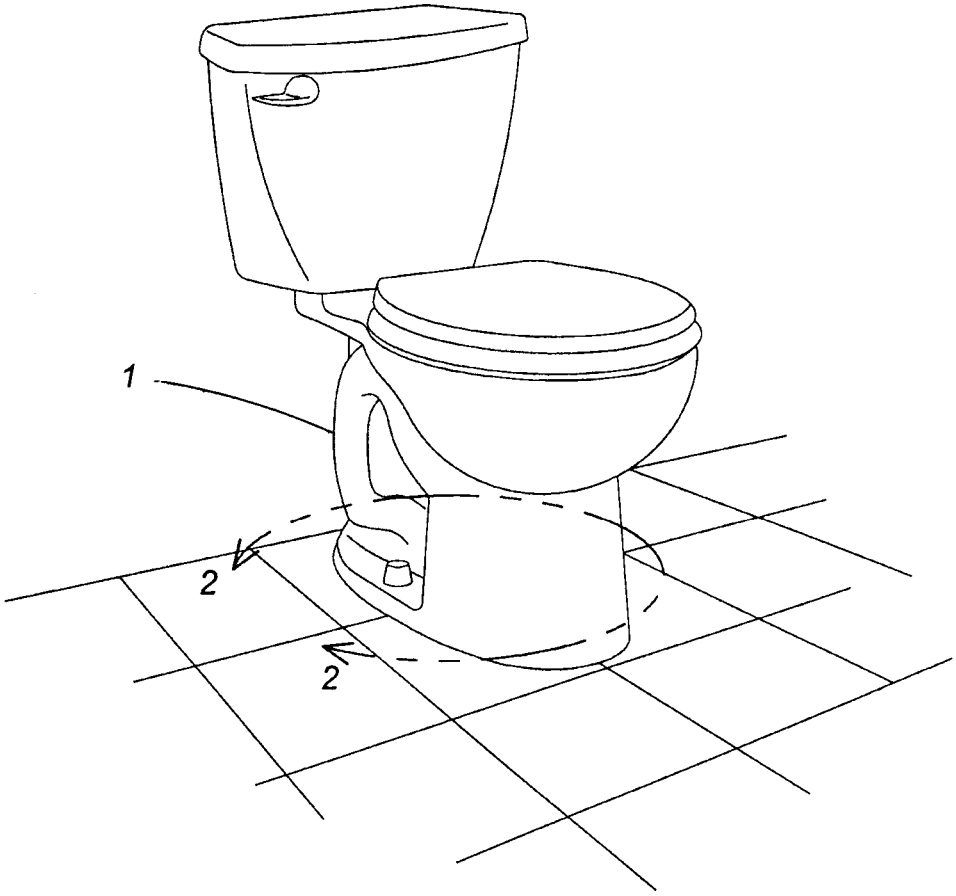
FIG. 1 is a perspective view of a standard toilet showing the standard type of installation of a toilet.

While specific embodiments of the present invention are illustrated in the above referenced drawings and in the following description, it is understood that the embodiments shown are merely some examples of various preferred embodiments and are offered for the purpose of illustration only, and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE PREFERRED EMBODIMENT OF THE INVENTION

In the following description, numerous specific details are set forth such as examples of some preferred embodiments, specific components, devices, and methods, in order to provide a thorough understanding of embodiments of the present disclosure. It will be apparent to a person of ordinary skill in the art that these specific details need not be exclusively employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill.

At least one preferred embodiment of the present invention is illustrated in the drawings and figures contained within this specification. More specifically, some preferred embodiments of the present invention are generally disclosed and described in FIGS. 1-7A.

Referring now to FIG. 1, the standard mounting arrangement for a standard toilet assembly 1 is shown. In this arrangement the toilet 1 is generally resting on the surface of the floor 2. It is noted that the term "floor" as used herein is intended to mean the floor, subfloor, or any other surface disposed near the underside of the standard toilet assembly 1 after it has been installed.

Figure 2:
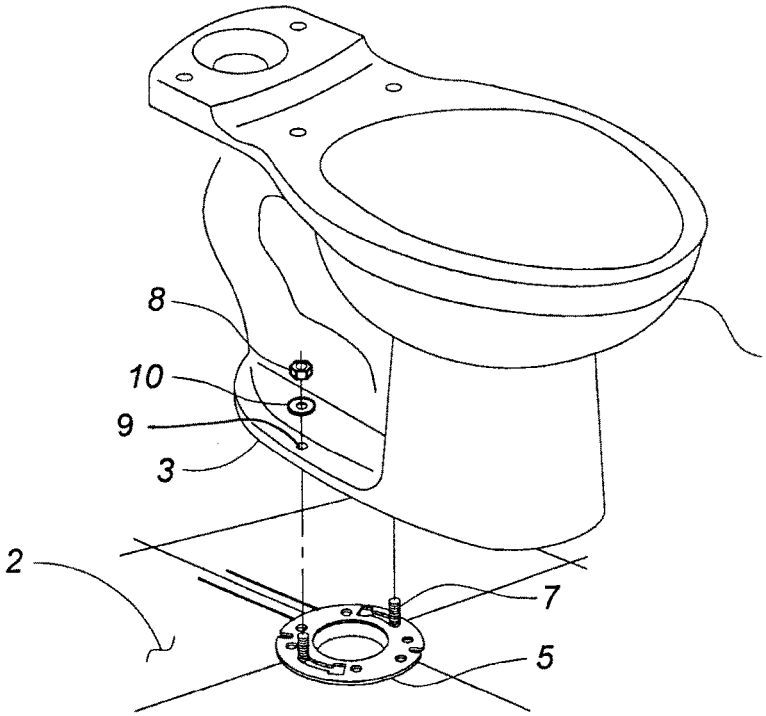
FIG. 2 is an exploded view showing the mounting arrangement of a toilet onto the toilet mounting flange.

The exploded view of FIG. 2 shows the mounting of the toilet 1 to the restroom floor 2 and the toilet mounting flange 5 that is installed between the bottom surface 3 of the toilet and the restroom floor. The mounting flange 5 generally includes at least two mounting studs 7 that are installed with the toilet mounting flange 5. During installation of the toilet 1 each of the two mounting studs 7 are inserted through one of the two mounting openings 9 in the toilet and nuts 8 and washers 10 are threaded onto the mounting studs to attach the toilet 1 to the mounting flange 5.

While there are a number of various and alternative embodiments of the present invention, there are two noteworthy preferred embodiments. In a first embodiment, the toilet leak detector device A (FIGS. 3-6A) comprises a toilet flange upon which two detection conductors are disposed. In this embodiment, the toilet flange and the detection elements comprise a single assembly that can be mounted between a toilet and the sewer line connection in the floor of a restroom. In a second embodiment, the toilet leak detector A (FIGS. 7-7B) comprises a substrate upon which at least two detection conductors are disposed. In this embodiment, one or more of the leak detector devices A can be installed in one or more locations between the bottom surface of the toilet 3, the mounting flange 5, and the floor installation of the toilet at the location where leakage of liquids and/or waste products can be best detected.

Figure 3A:
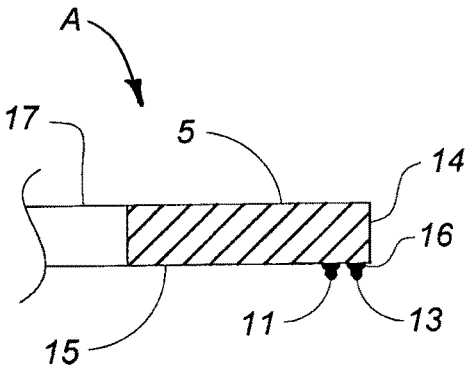
FIG. 3A is a vertical cross section of one embodiment of the present invention.
Figure 3:
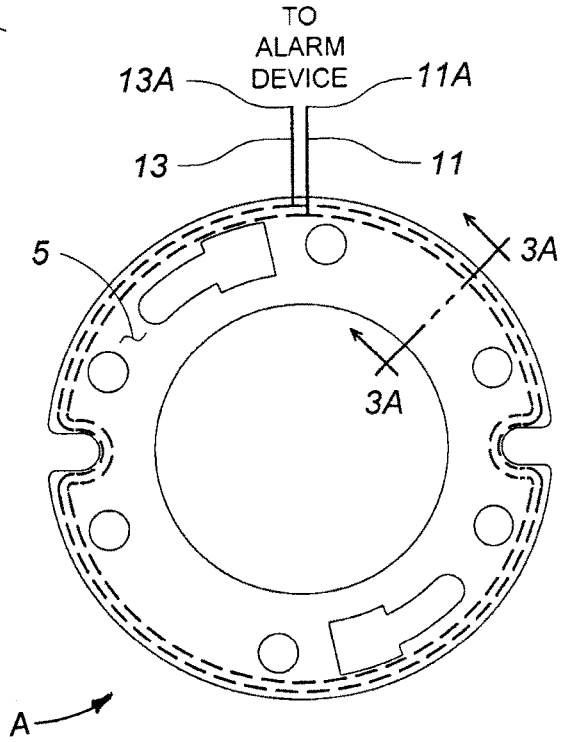
FIG. 3 shows a plan view of one embodiment of the present invention.

An example of the first embodiment of the present invention for a toilet leak detector A is shown in FIGS. 3 and 3A. In this embodiment, a first detection conductor 13 and a second detection conductor 11 are disposed near the bottom surface 15 of a toilet flange 5. To prevent electrical shorting of the two detection conductors 11 and 13, each of the conductors is insulated from the material used to manufacture the flange 5 by placement of an insulation material 16 between each of the detection conductors and the toilet mounting flange material if the flange material is electrically conductive. In this embodiment, no detection conductors are positioned on the upper surface 17 or the outer edge of the toilet flange 5. In a preferred version of the present embodiment, the first detection conductor 11 and the second detection conductor 13 are disposed near the bottom surface 15 of the toilet flange 5 and are routed such that no part of any detection conductor passes through any of the mounting openings or slots of the flange. In other versions of the present embodiment, the two detection conductors 11 and 13 may pass through or around any of the openings of the toilet flange as long as the positioning of the two detection conductors does not result in electrical continuity between the first detection conductor 11 and the second detection conductor 13 and there is no electrical discontinuity along any single detection conductor 11 or 13 after installation of the present embodiment. It is understood by those of skill in the art that the conductors in any of the embodiments of the present invention can be of any electrically conductive material as long as the material used is acceptable as an electrical conductor under standard electrical codes or electrical engineering designs standards and still remain within the intended scope of the claims.

The two detection conductors 11 and 13 are positioned such that there is a gap between the two detection conductors. It is understood that the gap is to be sized and configured such as to prevent electrical continuity between the first detection conductor and the second detection conductor until a sufficient amount of an electrically conductive substance, including fluid substances, is disposed within the gap. Thus, the gap can be adjusted as needed to fit any particular application for this embodiment of the present invention. Each of the two detection conductors 11 and 13 can include a pigtail portion 11A and 13A for electrical connection to an alarm device that can communicate a leak detection signal to the alarm device to notify others of a leak. In other versions of this embodiment, each of the two detection conductors 11 and 13 can include any type of connector for transmission of the leak detection signal to the alarm device.

In certain embodiments of the present invention, the alarm device is a continuity signaling device, Lowes Model #3320-L Contact Sensor. It is understood that other alarm devices may be used as long as the selected alarm device accepts signals from two or more detection conductors and issues an alert of some kind to indicate that the detection conductors have noted a leak. In applications where there are multiple circuits of detection conductors, certain embodiments of the present invention route the signals within the system through use of a Lowe's IRIS system, Model #9412-L hub. As before, yet other hubs may be used as long at the hub can allow for the transfer of any signal from any set of detection conductors and keep those signals segregated to allow for the identification of the location of any leak detected by the present embodiments.

In an example of the second embodiment, the toilet leak detector A (FIGS. 7 and 7A) comprises the first detection conductor 11 and the second detection conductor 13 disposed on a mounting substrate 51. In this embodiment, the substrate 51 is electrically conductive and the two detection conductors are separated from the substrate by an insulating material 53. If the substrate 51 is not electrically conductive, then the two detection conductors 11 and 13 can be mounted directly onto the substrate without the need for any insulation material 53. In this embodiment, the substrate 51 is generally circular in shape and of a size and configuration to allow the substrate to be disposed at or near the standard toilet mounting flange during installation of the toilet. It will be appreciated by those of skill in the art, however, that the substrate 51 can be any shape as needed for any particular application of any of the embodiments of the present invention. This assembly can then simply be installed between a standard toilet mounting flange 5 and the bottom surface of the toilet 3 during installation of the toilet. Depending on any specific installation, the assembly can also be mounted in any position where a leak will most likely occur at the bottom of a toilet. This is to say, the assembly can be mounted directly beneath the toilet itself or between any two surfaces at the bottom of the toilet where a potential leak may occur. It is appreciated by those of skill in the art that the substrate material 51 can be of any materials and thicknesses as needed to fit any particular application and still remain within the scope of the present invention. It is also understood by those of skill in the art that in most of the embodiments of the present invention that the substrate 51 should not block or protrude into any of the mounting openings of the toilet mounting flange 5. Therefore, it is understood that in those embodiments the substrate 51 can be manufactured and configured to have portions of the substrate pre-removed during manufacture so as not to block or protrude into any of those flange mounting holes. In an alternative embodiment, the substrate does not have any pre-removed portions but is instead a generally continuous substrate material that is then cut or modified by the manufacturer during fabrication, or by the installer during installation, so as to remove any portions of the substrate that protrude into any of the flange mounting holes needed for installation in any specific application.

Figure 7:
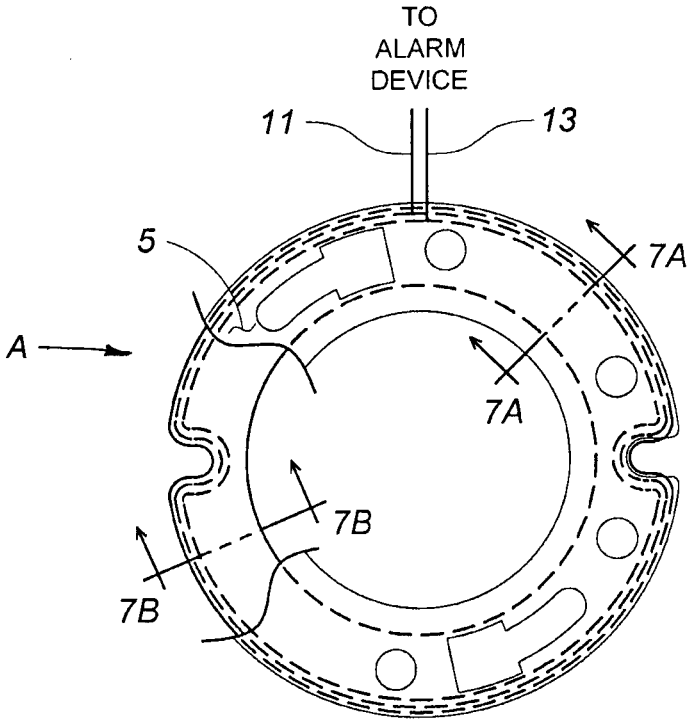
FIG. 7 is a plan view of one embodiment of the invention that incorporates a substrate mounting surface.
Figure 7A:
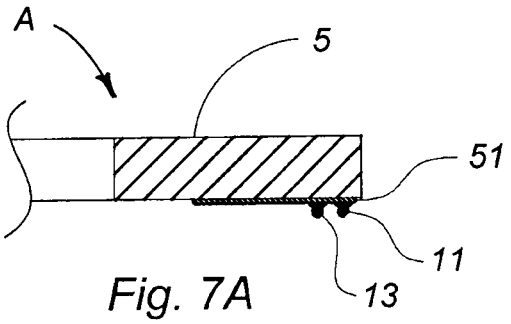
FIG. 7A is a vertical cross section of one embodiment of the present invention that incorporates a substrate mounting surface.
Figure 7B:
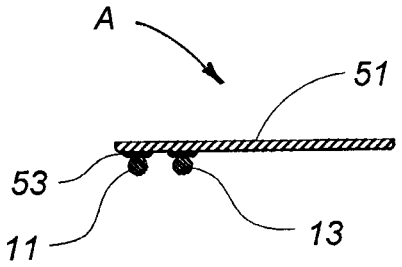
FIG. 7B is a vertical cross section of one embodiment of the present invention showing an alternative mounting of the detection conductors.

Finally, it is also understood that while the first detection conductor 11 and the second detection conductor 13 in the present embodiment are disposed on a mounting substrate 51 that has been located on the underside of the flange (FIG. 7A), that location can be changed as needed to enhance the detection of leaks at any position on the flange. For example, the first detection conductor 11 and the second detection conductor 13 disposed on the mounting substrate 51 could be positioned on the top surface of the mounting flange and still remain within the scope of the present embodiment. It is also noted that while FIG. 7B shows the first detection conductor 11 and the second detection conductor 13 disposed side by side and near the edge of the mounting substrate 51, the first detection conductor 11 and the second detection conductor 13 can be disposed on any surface or location of mounting substrate 51. It is also understood that while the embodiments herein comprise only one detection set that includes the first detection conductor 11 and the second detection conductor 13, there are other alternative embodiments where more than one detection set is mounted onto the substrate. For example, in an alternative embodiment, one detection set can be placed on the top surface of the substrate 51 and a second detection set can be positioned on the bottom surface of the substrate.

In an alternate version of this embodiment, each of the detection conductors is mounted on a separate substrate. In that version, each of the detection conductors can then be placed in any location on or near the bottom of the toilet, the seal, or the toilet flange to best detect where the expected leak may occur. It is noted that in this version, each of the detection conductors can be placed on the top, bottom, or edges of the toilet flange as needed in the specific application.

In some versions of the present embodiment, the substrate can also include an adhesive that is placed on one side of the substrate that is on the opposite side from where the detection conductor is disposed. In that version, the substrate can be directly applied to any part of the toilet, seal, or toilet flange and remain in place as the adhesive bonds to the selected surface.

In other versions of the above embodiments, the two detection conductors 11 and 13 are not mounted directly onto the surfaces of either a toilet flange 5 or a substrate 51, but are installed into a groove that exists in either the toilet flange or the substrate. In this version, the depth of the grooves should be about the same as the outside diameter of the two detection conductors 11 and 13. It is understood that the configuration of the grooves can be as needed to fit any specific application and can be rectangular, semi-circular, elliptical, or any other geometric shape as long as the two detection conductors 11 and 13 are disposed near the toilet flange 5.

Figure 4:
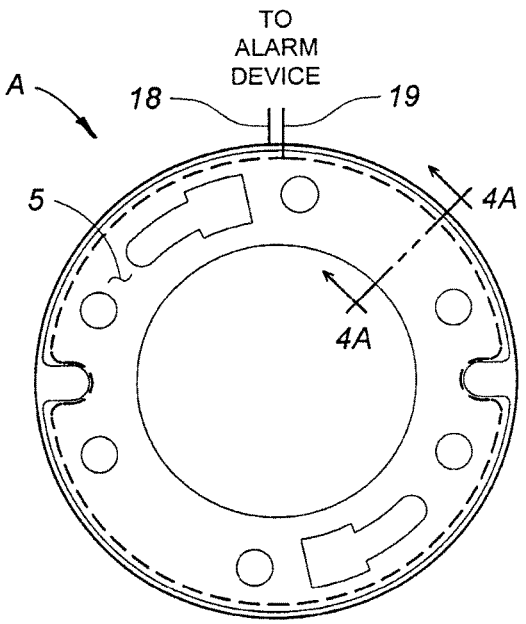
FIG. 4 is a plan view of a second embodiment of the present invention.
Figure 4A:
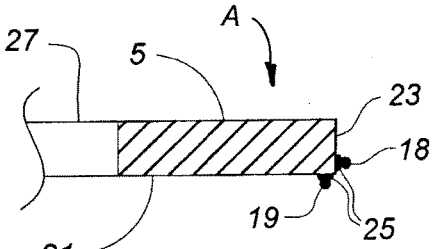
FIG. 4A is a vertical cross section of the second embodiment of the present invention.
Figure 5:
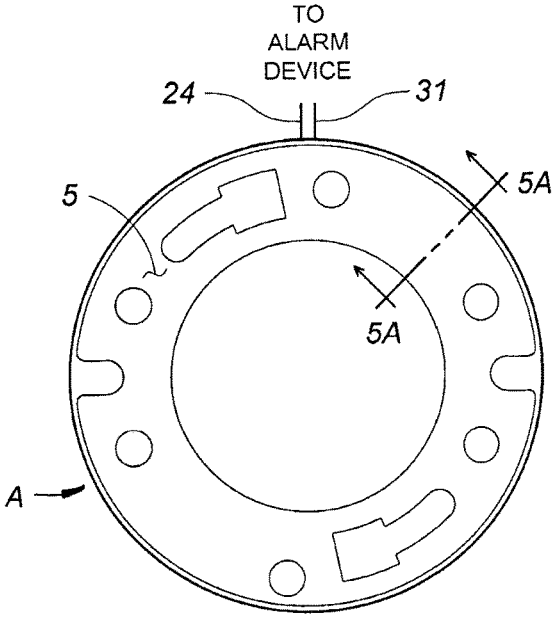
FIG. 5 is a plan view of a third embodiment of the present invention.
Figure 6:
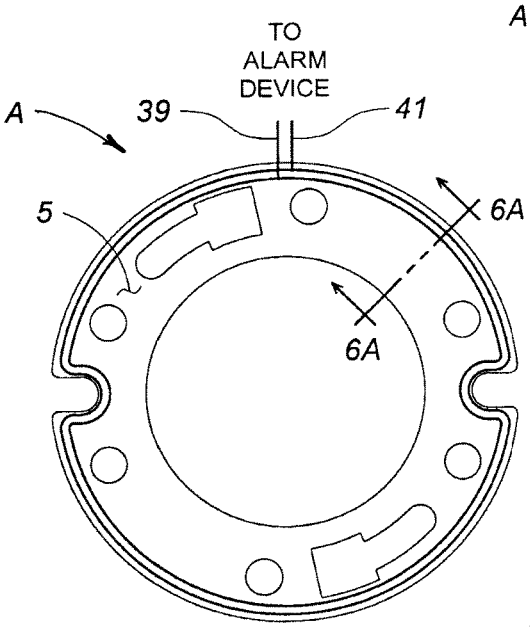
FIG. 6 is a plan view of a fourth embodiment of the present invention.
Figure 5A:
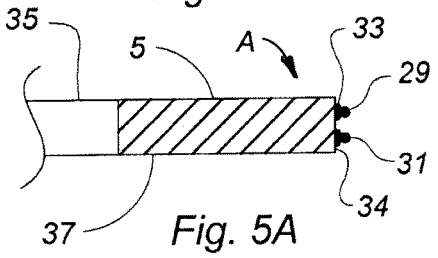
FIG. 5A is a vertical cross section of the third embodiment of the present invention.
Figure 6A:
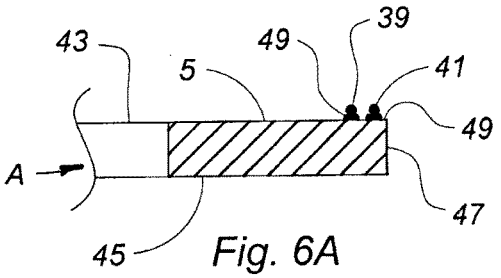
FIG. 6A is a vertical cross section of the fourth embodiment of the present invention.

In an alternative embodiment, the toilet leak detection device A is like the embodiments above, but with detection conductors disposed in various other positions on either the toilet flange 5 or the substrate 51. For example, FIGS. 4 and 4A show the first detection conductor 18 located at an outer edge 23 of the toilet flange 5 while the second detection conductor 19 is disposed at the bottom surface 21 of the toilet flange 5. In an alternative embodiment as shown in FIGS. 5 and 5A, both the first detection conductor 29 and the second detection conductor 31 are located at the outer edge 34 of the toilet flange 5.

In yet another alternative embodiment, (FIGS. 6 and 6A) both the first detection conductor 39 and the second detection conductor 41 are located at the upper surface 43 of the toilet flange 5.

Yet other embodiments of the invention can be configured and still remain within the intended scope of the present invention. It is understood that a leak might occur in a monitored area that includes any location between the bottom surface of the base of a toilet and the flange upon which the toilet is mounted, or any other potential leak area under the toilet. Therefore, it will be appreciated by those of skill in the art that either the first detection conductor or the second detection conductor can be positioned at any location between the bottom of surface of the base of the toilet and the flange upon which the toilet is mounted. The actual location chosen would be selected to allow detection conductors to detect any potential leak at any location in that monitored area. For example, in one embodiment of the present invention the first detection conductor can be positioned between the bottom surface of the toilet and the upper surface of a seal that has been positioned between the bottom surface of the toilet the toilet mounting flange, while the second conductor might be placed between the bottom of the seal and the top surface of the toilet mounting flange, or the bottom of the toilet mounting flange and the floor upon which the toilet is resting, or at any other location that can potentially be a source of a leak. It is also understood that more than one set of detection conductors may be used at a single installation. For example, while many of the embodiments herein comprise only one detection set that includes the first detection conductor 11 and the second detection conductor 13, other alternative embodiments can include more than one detection set. For example, in one alternative embodiment, a first detection set can be placed between the bottom of the base of the toilet and a second detection set of conductors can be located between the bottom of the toilet flange and the floor upon which the toilet has been mounted. In fact, any number of detection sets of detection conductors can be used in any single installation and still remain within the intended scope of the claims.

In yet another alternative embodiment, each of the two detection conductors can be located at any part of either the toilet mounting flange 5 or the substrate 51 as long as there is a sufficient gap between the first detection conductor and the second detection conductor so that an electrical continuity results after at least a single drop of an electrically conductive liquid is positioned between the first detection conductor and the second detection conductor.

Figure 8:
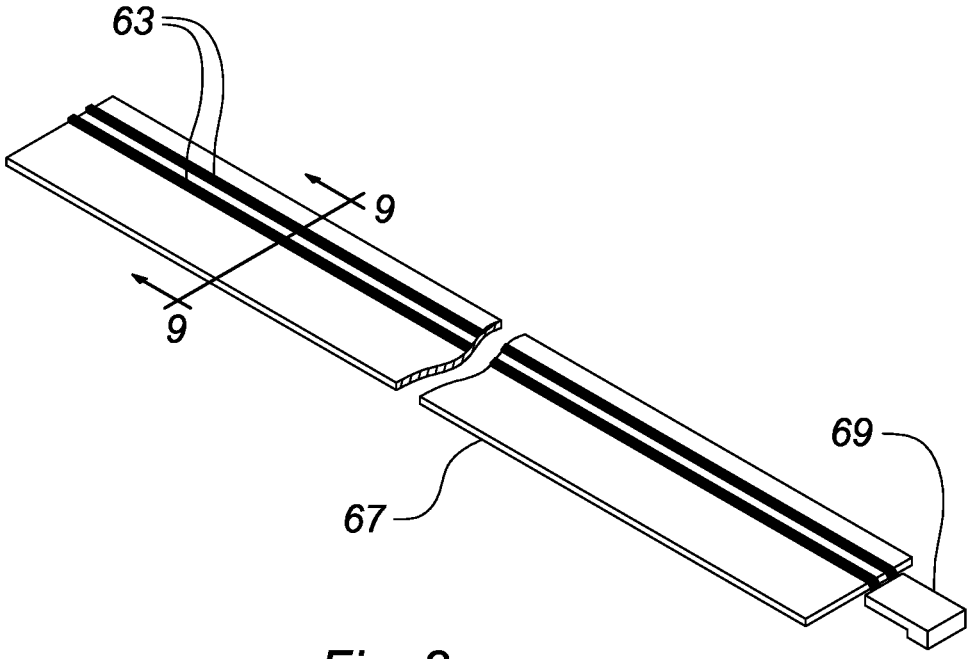
FIG. 8 is a perspective view of one embodiment of the present invention.
Figure 9:
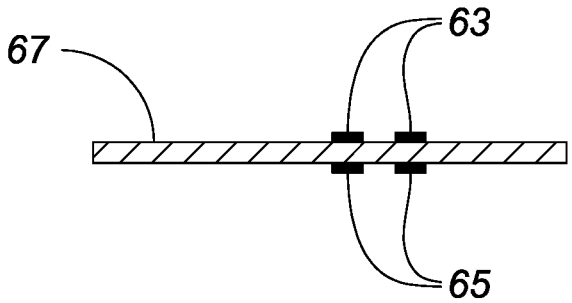
FIG. 9 is a vertical cross section of one embodiment of the present invention.

In one more alternate embodiment of the present invention, an upper set of detection conductors 63 (FIGS. 8 and 9) is disposed on the top surface of a substrate 67 and a second set of detection conductors 65 is disposed on a bottom surface of the substrate 67. In this embodiment, the substrate 67 is made from polyethylene terephthalate material having a width of between about 0.50 inch and about 1.5 inch, and a thickness of between about 0.05 mm and about 0.08 mm. In alternative embodiments, the substrate is about 0.003 inch in thickness. The overall length of the substrate is between about 5 inches and about 48 inches, and preferable about 30 inches. It is understood that the overall length and width of the substrate can be of any value and remain within the intended scope of the claims herein.

In this embodiment, each of the first detection conductor 63 and the second detection conductor 65 are made from a screen printing conductive paste used for membrane switch and flexible circuitry. For this version, the screen printing silver-based conductive paste has the general specifications and characteristics noted in Table 1 below.

TABLE 1

| Item | Unit | Specification |
|---|---|---|
| Solid Content | wt % | 58 ± 2.0 |
| Viscosity | Pa · s | 25 ± 5 |
| FOG (Fineness of Grind) | I'm | <10 |
| Specific Gravity | | 1.8 ± 0.2 |
| Cross-Cut & Peeling | — | 100/100 |
| Volume Resistivity | Dom | $<10^{-4}$ |
| Change of Crease Resistivity | % | <30 |

* Brookfield HB DV I+ #14 (@25° C., 50 rpm)

One source of the silver-based conductive paste used in this embodiment is available from Eisho Electronic Materials Co., Limited as a silver/silver coated nickel hybrid paste having part number Silver Paste: Paron-910A. In this embodiment, the silver-based conductive paste is applied in generally continuous strips of paste to the top and bottom surfaces of the substrate 67 to run about the full longitudinal length of the substrate to a width of between about 0.030 inch and about 0.060 inch in width and a thickness of between about 2 mils and about 7 mils, and preferably 5 mils. It is appreciated by those of skill in the art, however, that the overall width and length of the substrate can be of any value as needed to fit any particular application.

A connector 69 is disposed at one end of the length of substrate 67 and is operationally attached to the upper set of detection conductors 63 and the bottom set of detection conductors 65 to allow the communication of electrical signals to an alarm device when a leak is detected by either of the set of detection conductors 63 and 65. The connector used in the present embodiment is Molex part number 15-38-8040, but other connectors may used as long as the connector can communicate electrical signals from the sets of detection conductors to the selected alarm device.

It will be appreciated that any number of the above embodiments may be partially or wholly combined to generate yet other embodiments of the present invention. For example, one possible embodiment can include at least one conductor wire mounted to a substrate that is then installed in conjunction with a toilet flange upon which as least a second detection conductor has been mounted. Yet other combinations of detection conductors, methods of mounting the detection conductors, and placement of any of the detection conductors on or near the toilet mounting flange will be understood by those of skill in the art.

In operation, the toilet leak detection device A is installed between the toilet 1 and the toilet mounting point on a restroom floor 2. If the embodiment of the toilet leak detection device A includes the disposing of the two detection conductors on a toilet mounting flange, the toilet mounting flange is installed between the toilet 1 and the sewer line connection in the restroom floor 2. After the installation is complete, the leak of any electrically conductive fluid results in a completed electrical circuit between the first detection conductor and the second detection conductor. That completion is detected by an alarm system that can then communicate an alarm signal that signifies the condition in which a drop of electrically conductive fluid has become disposed in the gap between the first detection conductor and the second conductor. That alarm constitutes a signal that the toilet leak detector has detected a fluid leak between the connection point of a toilet and the toilet mounting flange. Steps necessary to address and repair the detected leak can then be taken.

In the preceding description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill. The scope of the invention should be determined by any appended claims and their legal equivalents, rather than by the examples given.

Additionally, it will be seen in the above disclosure that several of the intended purposes of the invention are achieved, and other advantageous and useful results are attained. As various changes could be made in the above constructions without departing from the scope of the invention, it is intended that all matter contained in the above descriptions or shown in the accompanying drawings shall be interpreted as illustrative and not in a limiting sense.

Terms such as "proximate," "distal," "upper," "lower," "inner," "outer," "inwardly," "outwardly," "exterior," "interior," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It will also be understood that when an element is referred to as being "operatively connected," "connected," "coupled," "engaged," or "engageable" to and/or with another element, it can be directly connected, coupled, engaged, engageable to and/or with the other element or intervening elements may be present. In contrast, when an element is referred to as being "directly connected," "directly coupled," "directly engaged," or "directly engageable" to another element, there are no intervening elements present. Other words used to describe the relationship between elements should be interpreted in a like fashion (e.g., "between" versus "directly between," "adjacent" versus "directly adjacent," etc.).

What is claimed is:

1. A leak detection device comprising:

a first detection conductor;

a second detection conductor wherein the combination of the first detection conductor and the second detection conductor comprises a detection set;

one of either at least a substrate or a mounting device wherein the first detection conductor and the second detection conductor are disposed on one of either the substrate or the mounting device and wherein there is a gap between the first detection conductor and the second detection conductor to prevent any electrical continuity between the first detection conductor and the second detection conductor until an electrically conductive substance is disposed in the gap;

wherein the first detection conductor and the second detection conductor are made from a silver-based electrically conductive paste and wherein the silver-based electrically conductive paste is applied in generally continuous strips at a width of between about 0.7 mm and about 1.5 mm and a thickness of between about 2 mils and about 7 mils;

wherein the silver-based electrically conductive paste is applied to run substantially the full longitudinal length of the substrate or the mounting device; and, wherein each of the two detection conductors includes provisions for operatively communicating with an alarm device.

2. The leak detector device of claim 1 wherein the first detection conductor is disposed on a first substrate and the second detection conductor is disposed on a second substrate.

3. The leak detector device of claim 2 wherein the first detection conductor and the second detection conductor are electrically conductive and the circuit is an electrical circuit.

4. The leak detector device of claim 3 wherein the completion of the circuit constitutes a signal that the leak detection device has detected a leak.

5. The leak detector device of claim 2 wherein either one or both of the first detection conductor and the second detection conductor is disposed on one of either a top surface of the mounting device, the bottom surface of the mounting device, or an edge of the mounting device.

6. The leak detector device of claim 2 wherein an upper set of detection conductors is disposed on the top surface of the substrate and a second set of detection conductors is disposed on a bottom surface of the substrate.

7. The leak detector device of claim 6 wherein the substrate is made from polyethylene terephthalate material having a width of between about 12.7 mm and about 38.1 mm, and a thickness of between about 0.05 mm and about 0.08 mm.

8. The leak detector device of claim 7 wherein the substrate has an overall length of between about 5 inches and about 48 inches.

9. The leak detector device of claim 8 wherein the silver-based electrically conductive paste is applied at a width of between about 0.7 mm and about 1.5 mm and a thickness of between about 2 mils and about 7 mils.

10. The leak detector device of claim 9 further comprising a connector disposed at one end of the length of substrate and is operationally attached to the upper set of detection conductors and the bottom set of detection conductors to allow the communication of electrical signals to an alarm device when a leak is detected by either of the set of detection conductors.

11. The leak detector device of claim 10 wherein the overall length of the substrate is about 30 inches, wherein the thickness of the substrate is about 0.07 mm, and wherein the width of each of the conductors in each set of detection conductors is about 1.2 mm.

* * * * *